United States Patent [19]

Suzuki et al.

[11] 4,045,134

[45] Aug. 30, 1977

[54] PHOTOSENSITIVE MEMBER FOR USE IN ELECTROPHOTOGRAPHIC APPARATUS AND METHOD OF MANUFACTURING THE SAME

[75] Inventors: Shigeru Suzuki, Yokohama; Yasumori Nagahara, Yokosuka; Koji Sakamoto, Tokyo; Katsuo Sakai, Machida, all of Japan

[73] Assignee: Ricoh Company, Ltd., Japan

[21] Appl. No.: 662,723

[22] Filed: Mar. 1, 1976

[30] Foreign Application Priority Data

Mar. 5, 1975 Japan ..... 50-27530

[51] Int. Cl.[2] ..... G03G 15/00; G03G 5/02

[52] U.S. Cl. ..... 355/3 R; 96/1 PC; 96/1.5 R

[58] Field of Search ..... 355/3 R, 3 DR; 96/1 PC, 96/1.5

[56] References Cited

U.S. PATENT DOCUMENTS 3,981,728 9/1976 Jones ..... 96/1.5

FOREIGN PATENT DOCUMENTS 1,429,517 3/1976 United Kingdom ..... 96/1.5

*Primary Examiner*—L. T. Hix
*Assistant Examiner*—J. A. LaBarre
*Attorney, Agent, or Firm*—McGlew and Tuttle

[57] ABSTRACT

A photosensitive member for use in an electrophotographic apparatus in which a bias potential is applied to the member during development. The member comprises a conductive support having at least one support edge and a photosensitive layer formed on the surface of the support and extending up to a point substantially coincident with the support edge. A tapered surface is formed at the extremity of the photosensitive layer adjacent to each support edge which extends from the top of the photosensitive layer to the support edge. The maximum angle between a tangent of the tapered surface and the surface of the conductive support is less then 45° thereby preventing an edge effect by which a background smearing in the form of a black band may appear on copied paper obtained. Such a tapered surface can be easily formed through a vaporizing technique with a special masking in accordance with the present invention.

10 Claims, 9 Drawing Figures

| θ \ R | X | | | | | Y | | | | | Z | | | | |
|---|---|---|---|---|---|---|---|---|---|---|---|---|---|---|---|
| | 10 | 8 | 6 | 4 | 2 | 10 | 8 | 6 | 4 | 2 | 10 | 8 | 6 | 4 | 2 |
| 75° | + | ⊛ | △ | ○ | + | + | ⊛ | △ | ○ | + | − | ⊛ | ○ | ○ | ○ |
| 45° | + | △ | ○ | ○ | + | + | △ | ○ | ○ | + | − | △~○ | ○ | ○ | ○ |
| 30° | + | ○ | ○ | ○ | + | + | ○ | ○ | ○ | + | − | ○ | ○ | ○ | ○ |

| α (°) | θ (°) |
|---|---|
| 90 | 75 |
| 75 | 45 |
| 60 | 30 |
| 45 | 30 |
| 35 | 45 |
| 15 | 75 |

PHOTOSENSITIVE MEMBER FOR USE IN ELECTROPHOTOGRAPHIC APPARATUS AND METHOD OF MANUFACTURING THE SAME

BACKGROUND OF THE INVENTION

The invention relates to a photosensitive member for use in an electrophotographic apparatus and a method of manufacturing the same.

DESCRIPTION OF THE PRIOR ART

An electrophotographic apparatus is known for repeatedly carrying out a process in which an electrostatic latent image is formed on a photosensitive member and is then developed to convert it into a visual image, which is transferred onto a record sheet. In such an apparatus, the photosensitive member is moved in one direction, and is usually formed as a drum or belt. One construction of such a drum-shaped photosensitive member is illustrated in FIG. 1. Specifically, the member 1 comprises a drum 11 formed of aluminium which serves as a support for a photosensitive layer 12 disposed on the peripheral surface thereof and formed of an evaporated layer of selenium. A copying process takes place by rotating the member 1 about a rotary shaft so as to move its surface or the surface of the photosensitive layer 12 in one direction. In FIG. 1, *a* represents an effective image region within which an electrostatic latent image is to be formed. *b* represents the width of the photosensitive layer 12 and includes opposite end portions which are contiguous with tapered regions *c.* A photosensitive region is designated by *d. e* represents a marginal region, *f* a non-photosensitive region and *g* the width of the drum 11. By way of example, the region *a* measures 257 mm, the region *b* 297 mm, the region *c* 2 mm, the region *d* 301 mm, the region *e* 20 mm, the region *f* 5 mm, and the region *g* 311 mm. The photosensitive layer 12 has a thickness which may be on the order of 50 microns.

The non-photosensitive region *f* is provided in order to facilitate a handling of the photosensitive member 1, and the tapered region *c* is formed to prevent or suppress an exfoliation of the photosensitive layer 12 from the drum surface at the end of the photosensitive region *d.* The marginal region *e* is provided to prevent an electrostatic disturbance occurring in the tapered region *c* from influencing the effective image region *a.* In the above example in which the layer 12 is 50 microns thick and the tapered region *c* measures approximately 2 mm, the tapered region *c* may have an angle of depression at the end of the region *b* which is less than two degrees.

It is desirable to minimize the tapered region *c* and the marginal region *e* so as to have the effective image region *a* commensurate with the region *b* ideally, or to have at least one end of the effective image region *a* coincident with a corresponding end of the region *b* in order to reduce the axial length of the photosensitive member 1 and hence of the electrophotographic apparatus and to minimize the photosensitive layer 12 and hence the quantity of insulating, photoconductive material which is required to form it.

The coincidence of at least one end of the region *b* with one end of the effective image region is essential in an arrangement as illustrated in FIG. 2 of the prior art wherein one end of a record sheet S, which is disposed in superimposed relationship with the surface of a photosensitive member 2, projects beyond a corresponding end of the member 2 so that the projecting end of the record sheet S may ride up a suitable guide member after the completion of the transfer in order to facilitate the separation of the record sheet S from the surface of the photosensitive member 2. If the end of the effective image region and the end of the region *b* do not coincide with each other on this side the, end of the record sheet S projects beyond the corresponding end of the photosensitive member 1, and if a marginal region is additionally required, the record sheet S will have to have an increased width, resulting in a waste of the sheet material.

A practical arrangement has been constructed in the manner so that an electrostatic latent image is formed to the end of the photosensitive member 2 from which the record sheet S projects. That is to say, the effective image region and the region *b* of the photosensitive layer 22 have been made coincident at this end. A non-image area in the latent image which was exposed to radiation had a residual potential of +200 V, and a developing step took place with the bias potential of +250 V applied to the developing station. When the visual image obtained is transferred onto a record sheet S, there occurred a background smearing in the form of a black band having a width of approximately 5 mm, at a position corresponding to the overlapping end of the photosensitive member, even though it should have been left white inherently.

SUMMARY OF THE INVENTION

It is an object of the invention to provide a photosensitive member for electrophotography having at least one end of its effective image region coincident with a corresponding end of the photosensitive layer and which avoids the occurrence of background smearing in the form of a black band, and to a method of manufacturing a photosensitive member.

DETAILED DESCRIPTION OF THE PREFERRED EMBODIMENTS OF THE INVENTION

Figure 2:
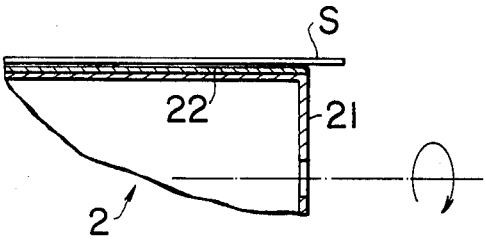
FIG. 2 (PRIOR ART)
FIG. 2 is a cross section of a prior art photosensitive member having the end of its effective image region made coincident with a corresponding end of a photosensitive layer.
Figure 3:
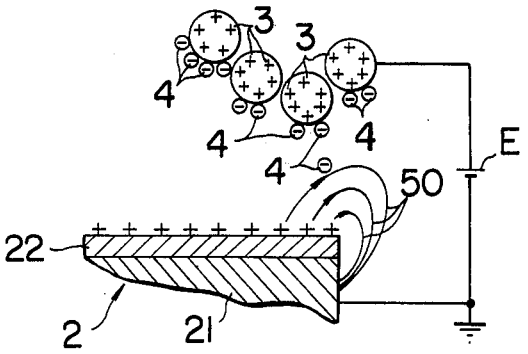
FIG. 3 (PRIOR ART)
FIG. 3 is a schemtic view illustrating the occurrence of an edge effect at the end of the effective image region of a prior art photosensitive member as shown in FIG. 2.

It is considered that the background smearing in the form of a black band is caused by an edge effect which results from a difference in the potential between the end of the photosensitive layer 22 and an aluminium drum 21 which is formed as a support for the photosensitive member in the prior construction of FIG. 2. Specifically, when an electrostatic latent image is formed to the end of the effective image region which is coincident with a corresponding end of the photosensitive layer 22, an electric field is established in a nonimage area adjacent to said end by a residual charge on the photosensitive member 2, a charge of a carrier particle 3 which constitutes a magnet brush, and a charge of a group of toner particles 4 retained by the carrier 3 (see FIG. 3). Since a bias potential applied to the carrier particle 3 from a d.c. source E is slightly higher than the potential presented by the residual charge on the photosensitive member 2, the force acting upon the toner particles 4 will be weak in a non-image area which is removed from the vicinity of said end. However, in the vicinity of the coincident end of the effective image region and the photosensitive layer, there exist electric lines of force 50 which pass through the air to the drum 21 which is at the ground potential. As a consequence, if the surface potential of the photosensitive member 2 presented by the residual charge is high relative to the ground potential, there is produced an electric field in the end of the effective image region which attracts the toner particles 4 toward said end of the effective image region, thus producing an edge effect. It will be seen, therefore, that if the amount of exposure is increased to reduce the residual potential in the non-image area, the strength of the electric field which is produced at the end of the effective image region can also be reduced, thus minimizing the edge effect. In actuality, it has been confirmed that a background smearing in the form of a black band is avoided if the residual potential of the non-image area is reduced below 50 volts. Since the photosensitive layer 22 has a thickness on the order of 50 micorns, this means that a background smearing can be avoided by maintaining the maximum strength of the electric field produced at the end of the effective image region below 1V/micron. It is possible to provide an exposure so as to satisfy this requirement.

However, it is found in accordance with the invention that a background smearing in the form of the black band mentioned above can also be avoided in a practically operable range of amount of exposure, by providing an inclination or tapering to the end of the photosensitive layer 22 which is coincident with a corresponding end of the effective image region, as will be further described below.

Figures 4, 5, 9:
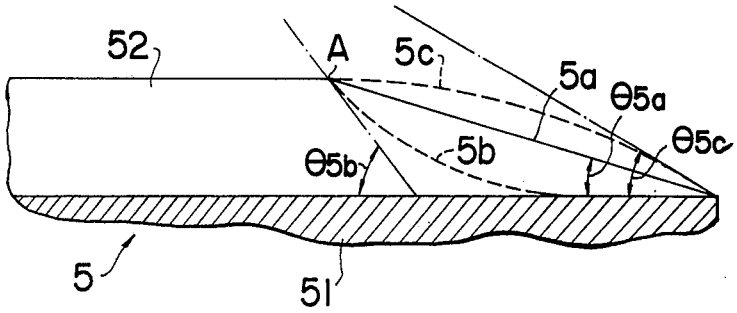
FIG. 4 is a fragmentary view of one embodiment of the photosensitive member according to the invention.
FIG. 5 is a tabulation illustrating the effect of the invention.
FIG. 9 is a table illustrating the relationship between the angle of inclination $\alpha$ and the maximum angle of inclination $\theta$ of the tapered region shown in FIG. 8.

FIG. 4 is a fragmental view of a photosensitive member constructed in accordance with the invention, principally illustrating one end of the effective image region thereof to an enlarged scale. Specifically, a photosensitive member 5 is formed as a drum as before, and includes an end A of its effective image region which also defines one end of a photosensitive layer 52. The photosensitive member 5 is characterized in that the photosensitive layer 52 is tapered from the end A toward the surface of a drum 51 formed of an aluminium and which provides a support therefor. The configuration of the tapering may be rectilinear as indicated by a line 5*a* or may be curved as indicated by curves 5*b*, 5*c* in FIG. 4. It is the angle of inclination as measured between a tangent of the curved edges 5*c* or 5*b* or the linear surface 5*a* and the surface of the member 51 rather than the rectilinear or curved configuration of the tapering that influences the edge effect. In FIG. 4, the maximum angle of inclination for the elimination of the side effects with such surfaces 5*a*, 5*b* and 5*c* is designated by $\theta 5a$, $\theta 5b$ and $\theta 5c$, respectively. For the purpose of a general discussion, a maximum angle of inclination will be designated as $\theta$. FIG. 5 shows a relationship between the value of $\theta$ and the edge effect, which is obtained by changing the maximum angle of inclination $\theta$ in the tapered region at the end of the effective image region of the photosensitive member 5, when using an electrophotographic apparatus as shown in FIG. 6.

Figure 1:
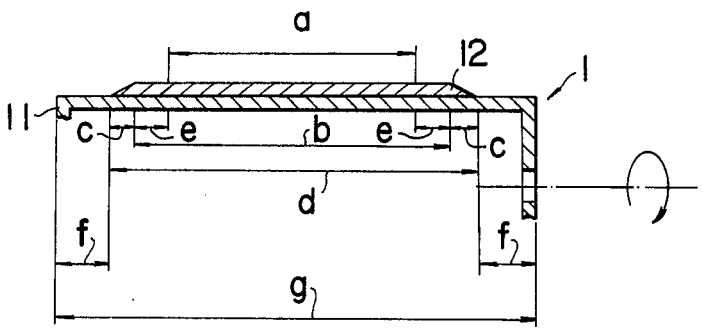
FIG. 1 (PRIOR ART)
FIG. 1 is a schematic section of one conventional prior art photosensitive member used for electrophotography.
Figure 6:
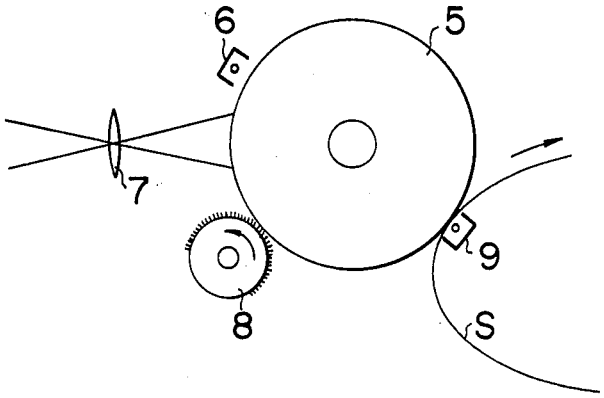
FIG. 6 is a schematic side elevation of an experimental apparatus which produced the results shown in FIG. 5.

Referring to FIG. 6, a numeral 6 represents a charger for charging the photosensitive member, 7 an optional system for effecting the exposure of the photosensitive member 5, 8 a developing unit of a magnet brush type, and 9 a transfer charger. In the experiment, three kinds of originals including a newspaper, a graphic illustration and a white paper have been used. An image area was maintained at a surface potential of 30 600V, and a bias potential of +200V was applied to the developing unit 8, and the toner concentration in the developer was maintained at 3.5 percent by weight. The amount of exposure was varied by controlling the flux of exposure radiation through a diaphragm, and a resulting copy imaged on a record sheet has been examined for the presence of a background smearing in the form of a black band. In the table of FIG. 5, the vertical columns represent the kind of the original used. Specifically, character X represents a newspaper, Y a graphic illustration and Z a white paper. Character R represents a scale setting of the diaphragm which is used to control the flux of exposure radiation and which provides a measure of the amount of exposure. The scaling is constructed such that the residual potential in a non-image area on the surface of the photosensitive member 5 will be +400V when R is equal to 10 and will be 0V for R =0. In the tabulation, the symbol + represents that the resulting copy image is of a quality such that it cannot be practically used. The symbol * represents a noticeable presence of the background smearing in the form of the black band, and the symbol Δ indicates an appreciable presence of the background smearing while the symbol o represents a complete absence of the background smearing in the form of a black band. FIG. 5 clearly indicates the existence of a tendency for the background smearing to be reduced or eliminated as the amount of exposure is increased, irrespective of the kind of the original. This is in accord with the previous observation. Additionally, as the maximum angle of inclination $\theta$ in the tapered region at the end of the region of the photosensitive member 5 is reduced, the background smearing tends to be removed. From a practical point of view, therefore, it will be appreciated that for a maximum angle of inclination $\theta$ in the tapered region at the end of the effective image region of the photosensitive member 5 which is less than 45°, the background smearing in the form of the black band can be considered as removed for a practicable range of amount of exposure, independently from the kind of the original. In other words, when the maximum angle of the inclination $\theta$ is less than 45°, it is presumed that the maximum strength of the electric field in the non-image area at the end of the effective image region does not exceed 1V/micron. The tapered region formed in this manner at the end of the effective image region has a width which does not exceed 0.5 mm at most, and should be essentially distinguished from the tapered region *c* shown in FIG. 1. Nevertheless, the tapered region according to the invention serves preventing or suppressing an exfoliation of the end of the photosensitive layer 52 from the surface of the drum 51 in the same manner as the tapered region of FIG. 1.

Figure 7:
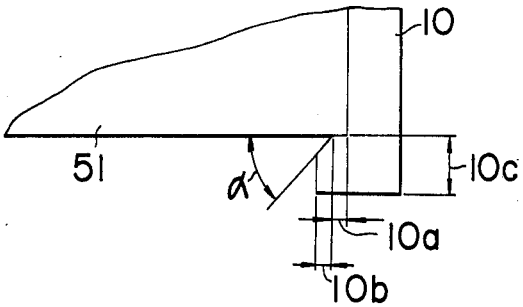
FIG. 7 is a schematic view illustrating one method of manufacturing the photosensitive member according to the invention.

FIG. 7 illustrates the manufacturing of the photosensitive member according to the invention, that is, an evaporation of selenium as a photosensitive material. As illustrated, a ring 10 is disposed against the peripheral surface of the drum 51 and is provided with a bevelled portion having an angle of inclination $\alpha$. Then, the assembly is placed in vacuo and selenium is heated to a temperature between 350° C and 400° C to effect evaporation. Thereupon, the evaporated photosensitive layer will be formed with a tapered end which is formed by the bevelled portion of the ring 10. In FIG. 7, the ring includes a region 10a on the order of 0.5 to 1 mm which serves to produce a non-evaporated region on the photosensitive member 5, thus facilitating a handling thereof. If the selenium were deposited to the end of the drum 51, the deposited selenium layer will be liable to exfoliation at its end when dismounting the photosensitive member 5 from the evaporation apparatus. In addition, an exfoliation of the end of the deposited layer must be prevented by disposing the photosensitive member 5 on a special support means. However, the provision of the non-deposited area permits the photosensitive member 5 to be stocked with its end face placed on a suitable base. The reference character **10*b* represents the width of the projected component of the bevel portion of the ring 10 on the surface of the drum 51. The character 10*c* denotes the difference between the radius of drum 51 and that of the ring 10. As shown in FIG. 7, the portions of the part 10*a*, 10*b* and 10*c*** are approximately in the ratio of from 1:1:4.

Figure 8:
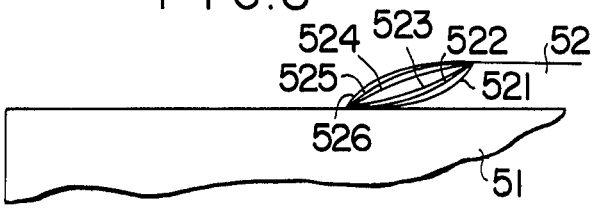
FIG. 8 shows the relationship between the angle of inclination $\alpha$ shown in FIG. 7 and the configuration of the tapered region at the end of the effective image region.

FIG. 8 shows various configurations for the tapered region of the photosensitive layer 52 when the angle of inclination $\alpha$ is varied. Specifically, tapered profiles 521, 522, 523, 524, 525 and 526 are formed by using an angle of inclination $\alpha$ of 15°, 30°, 45°, 60°, 75° and 90°, respectively. Relationship between the maximum angle of inclination $\theta$ of the tapered profiles 521 to 526 and the angle of inclination $\alpha$ is shown in FIG. 9. As will be evident from this table, the photosensitive member 5 according to the invention can be formed by employing an angle of inclination $\alpha$ in a range from 30° to 75° in the bevelled portion of the ring 10 which is used for the evaporation of selenium.

It should be understood that the invention is not limited to drum-shaped photosensitive member, but may be equally applied to a belt-shaped photosensitive member.

What is claimed is:

1. A photosensitive member for use in an electrophotographic apparatus which comprises means adjacent the surface of said member for appying a bias potential of the same polarity as an electrostatic latent image on said surface, toner being interposed between said means and said surface to develop said electrostatic image, said photosensitive member comprising a conductive support having a support surface with at least one support edge, and a photosensitive layer formed on said support surface and having an end extending up to a point substantially coincident with said support edge, the improvement comprising a tapered surface formed on said layer at said end extending from the top of said layer toward the support edge, the maximum angle between a tangent of said tapered surface and said support surface being less than 45°.

2. A member according to claim 1, wherein said conductive support comprises an uncovered region of a width below 1 mm between said support edge and the lowermost edge of said tapered layer surface.

3. A member according to claim 1, wherein said support is a drum.

4. A member according to claim 1, wherein said support is a belt.

5. A method of manufacturing a photosensitive member comprising a support and a photosensitive layer, of a material able to be vaporized, formed on the surface of said support and having an end with a tapered surface extending from the top thereof to the support surface, the maximum angle between a tangent of said tapered surface and the support surface being below 45°, said method comprising the steps of masking on the region of the support surface which corresponds to the tapered region of the layer surface with mask means having a plane surface portion which forms an acute angle with respect to the support surface, said acute angle being within 35° to 75°, positioning the masked support in vacuum, and vaporizing said material to permit the deposition thereof on the non-masked area of the support surface.

6. A photosensitive device for use in an electrophotographic apparatus, comprising a support member having a support surface, a photosensitive layer on said support surface having a top substantially planar surface and at least one side edge adjacent the edge of said support surface which comprises a tapered surface, the angle of taper of said tapered surface measured from said support surface to the tapered surface being less than 45°.

7. A photosensitive device according to claim 6, wherein said tapered surface is a curved surface.

8. A photosensitive device according to claim 6, wherein said tapered surface is a concave curved surface, the taper angle being measured by the angle between said support surface and a tangent to the curved surface at said top planar surface.

9. A photosensitive device according to claim 6, wherein said support surface is a convex curve wherein the taper angle is measured by the angle between said support surface and a tangent to said curve at said support surface.

10. A photosensitive device according to claim 6, wherein said support surface comprises a linear surface.

* * * * *